US008156611B2

(12) United States Patent
Machin et al.

(10) Patent No.: US 8,156,611 B2
(45) Date of Patent: Apr. 17, 2012

(54) LIFT-OFF DOOR HINGE

(75) Inventors: Ronald Machin, Ann Arbor, MI (US); Craig A. Moccio, Milan, MI (US); Patrick L. Folk, St. Clair Shores, MI (US); Joshua R. Kesten, Dexter, MI (US); John O. Wheeler, Milford, MI (US); Lothar Budde, Bergisch Gladbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 396 days.

(21) Appl. No.: 12/184,667

(22) Filed: Aug. 1, 2008

(65) Prior Publication Data

US 2010/0024164 A1 Feb. 4, 2010

(51) Int. Cl.
*E05D 7/10* (2006.01)

(52) U.S. Cl. ..... 16/261; 16/254; 16/260; 16/262; 296/146.11

(58) Field of Classification Search ..... 16/254, 16/260, 261, 262, 263, 264, 265, 266, 270; 296/146.11
See application file for complete search history.

(56) References Cited

U.S. PATENT DOCUMENTS

| | | | | |
|---|---|---|---|---|
| 4,383,478 | A * | 5/1983 | Jones | 16/273 |
| 4,765,025 | A | 8/1988 | Salazar | |
| 4,766,643 | A | 8/1988 | Salazar | |
| 4,854,009 | A * | 8/1989 | Brockhaus | 16/263 |
| 4,864,687 | A * | 9/1989 | Calcaterra et al. | 16/237 |
| 4,881,298 | A | 11/1989 | Turnbull | |
| 5,127,132 | A * | 7/1992 | Karlin | 16/261 |
| 5,590,441 | A | 1/1997 | Spencer | |
| 5,706,556 | A * | 1/1998 | Kluting | 16/273 |
| 5,987,703 | A * | 11/1999 | Kluting et al. | 16/262 |
| 6,357,081 | B1 | 3/2002 | Bender | |
| 6,591,451 | B2 * | 7/2003 | Gruber et al. | 16/262 |
| 6,718,596 | B2 | 4/2004 | Kohlstrand et al. | |
| 6,817,062 | B2 * | 11/2004 | Cho | 16/328 |
| 6,922,872 | B2 * | 8/2005 | Gruber | 16/260 |
| 7,059,032 | B2 | 6/2006 | Lehner | |
| 7,748,768 | B2 * | 7/2010 | Hofacker et al. | 296/146.11 |
| 2004/0025294 | A1 * | 2/2004 | Gruber | 16/254 |
| 2004/0231103 | A1 * | 11/2004 | Magnuson | 16/340 |

FOREIGN PATENT DOCUMENTS

| | | | |
|---|---|---|---|
| DE | 3128068 | | 2/1983 |
| DE | 4010466 | A1 * | 10/1991 |
| DE | 4012420 | A1 * | 10/1991 |
| GB | 2180884 | A * | 4/1987 |
| WO | 2008006191 | | 1/2008 |

* cited by examiner

*Primary Examiner* — Victor Batson
*Assistant Examiner* — Jeffrey O Brien
(74) *Attorney, Agent, or Firm* — Gregory P. Brown; Price Heneveld LLP

(57) ABSTRACT

A vehicle door attachment unit for rotatably and detachably coupling a vehicle door to a vehicle body. The unit may include a bodyside bracket mountable to the vehicle body and having first and second portions with respective first and second apertures, with the first and second portions extending generally away from the vehicle body. A doorside bracket may be mountable to the vehicle door and include a segment with a third aperture, the segment extending generally away from the vehicle door. A retaining mechanism may extend through the third aperture, and through the first and/or second apertures. A fastener may extend through at least one of the apertures and mate with the retaining mechanism to substantially align the first, second, and third apertures. A bearing may be disposed on the retaining mechanism for providing rotational freedom between the retaining mechanism, and the bodyside or doorside bracket.

3 Claims, 11 Drawing Sheets

LIFT-OFF DOOR HINGE

BACKGROUND OF INVENTION a. Field of Invention

The invention relates generally to hinges for vehicle closure members, and more particularly, to hinges that facilitate removal and installation of vehicle doors for expediting the vehicle assembly process.

b. Description of Related Art

As is known in the art, removing vehicle doors from a vehicle body during a particular segment of a vehicle assembly process, also known as a "doors off" technique, helps achieve automotive manufacturing efficiency. As opposed to keeping the doors on the vehicle body after initial attachment, this doors off technique provides increased access through door opening areas for facilitating installation of vehicle components, such as vehicle seats. After the doors are removed from the vehicle body on the primary assembly line, the doors may be separately outfitted in an off-line door assembly process. Window systems, door latches, door handles, and trim panels are a few of the exemplary components that can be installed on vehicle doors while removed from the vehicle body. Following this stage, the doors may be reattached to the vehicle body.

Many vehicle door-to-body hinges exist that attempt to make attaching, removing, and reattaching doors to the vehicle body as efficient as possible. In general, fewer parts that need to be removed and reattached correlates to better assembly efficiency. Some take-apart hinges allow a door to be detached from the vehicle body after one or more pins, bolts, etc. are removed from the hinge. The door is then lifted off the vehicle body for separate subassembly. Current lift-off hinges are typically made from profile stock or forgings, and are thus generally more costly than stamped hinges. Such profile and forged lift-off hinges cannot cost effectively package a locating pin on a body side bracket of the hinge to enable certain low investment door hang concepts. Conversely, current stamped hinges which incorporate a lift off feature compromise hinge strength or dimensional integrity.

Exemplary lift-off vehicle door hinges are disclosed in U.S. Pat. Nos. 4,765,025 and 4,766,643 to Salazar, respectively (Salazar '025 and Salazar '643). Referring to FIGS. 1-3 of Salazar '025 and Salazar '643, whereas the patents disclose the use of cost effective stamped brackets on the upper and lower hinges, the assemblies use a considerable number of fasteners to attach body mounting plate (20), door mounting plate (22), and door (14) to one another and to vehicle (10). Even if only one or two fasteners are used to hold the door in place until final assembly, driving a surplus of fasteners is detrimental to assembly time and component cost. One inefficiency is evidenced through the use of two pivot pins (24, 26) instead of one, which can add assembly and manufacturing time, and component cost.

In another exemplary stamped hinge assembly, U.S. Pat. No. 4,881,298 to Turnbull teaches a "separable door hinge" that has intertwining leaves, flanges, and tabs for maintaining the door in a fixed vertical position. One drawback to this separable door hinge is in its design to hold the door in a fixed position in relation to the height of the vehicle body. Referring to FIG. 1 of Turnbull, since the intertwining projections mentioned above, such as lower flange (52) rotating between tab (40) and lower flange (24), are not clamped by a traditional fastener, as shown in FIG. 2, relative movement of flanges (24, 52) during opening and closing of the door causes the intertwining projections to scrape one another. If the components have any free-play, even minimal vertical movement of the door can cause unnecessary fatigue on related components such as the striker member, the door latch, the periphery of the door opening, and the hinge components themselves. If the components are assembled too tightly, friction present during relative movement of the components can cause unnecessary fatigue on hinge components and undesirable noise and vibrations. Yet further, when a door is removed from the vehicle body, the main pivot is not kept intact.

Such deficiencies in existing technology make it desirable to provide a durable and robust door-to-body hinge that remains intact when the door is lifted off the vehicle body for separate subassembly. It is further desirable to provide a hinge that uses cost effective stamped components, and minimal joints for attaching, removing, and reattaching a door to a vehicle body.

SUMMARY OF THE INVENTION

The invention overcomes the drawbacks and deficiencies of the aforementioned hinge designs by providing a vehicle door attachment unit for rotatably and detachably coupling a vehicle door to a vehicle body, where the detachment interface is separate from the functional pivot interface. The unit may include a bodyside bracket mountable to the vehicle body and having first and second portions with respective first and second apertures, with the first and second portions extending generally away from the vehicle body. A doorside bracket may be mountable to the vehicle door and include a segment with a third aperture, the segment extending generally away from the vehicle door. A retaining mechanism may extend through the third aperture, and through the first and/or second apertures. A fastener may extend through one or more of the apertures and mate with the retaining mechanism to substantially align the first, second, and third apertures. A bearing may be disposed on the retaining mechanism for providing rotational freedom between the retaining mechanism, and the bodyside or doorside bracket.

For the vehicle door attachment unit described above, the bodyside and/or doorside brackets may be stamped from sheet metal. The unit may further include a collar generally concentric with the first and second apertures and extending between the first and second portions of the bodyside bracket, with the collar dispersing loads that are transmitted between the vehicle door and the vehicle body across the first and second portions of the bodyside bracket. The retaining mechanism may include an angular seat for engaging a chamfered rim adjacent one of the first and second apertures in the bodyside bracket, with the angular seat and chamfered rim facilitating alignment of the vehicle door attachment unit during assembly thereof. The fastener may include external threads and the retaining mechanism may include a cavity with complementary internal threads, with the external threads on the fastener being engageable with and disengageable from the internal threads of the cavity for respectively permitting assembly and disassembly of the vehicle door attachment unit. The unit may further include a locating pin and a locating hole along the bodyside bracket for receiving the locating pin, with the locating hole being oversized to provide the locating pin with a predetermined amount of translational freedom such that the vehicle door is adjustably mountable relative to the vehicle body. The doorside bracket may further include a doorstop disposed generally orthogonal along the segment and engageable with one of the first and second portions of the bodyside bracket to stop rotation of the vehicle door.

The invention also provides a vehicle door attachment unit for rotatably and detachably coupling a vehicle door to a vehicle body. The unit may include a bodyside bracket mountable to the vehicle body and having a portion extending generally away from the vehicle body, with the portion having an aperture. A doorside bracket may be mountable to the vehicle door and include a segment extending generally away from the vehicle door, with the segment having a further aperture alignable with the aperture in the portion of the bodyside bracket. A retainer may extend through one or more of the apertures. A fastener may extend through one or more of the apertures and be capable of mating with the retainer to substantially align the apertures. A rotation member may be operatively engaged with the retainer for providing rotational freedom between the retainer and one of the bodyside and doorside brackets.

For the vehicle door attachment unit described above, the bodyside and/or doorside brackets may be stamped from sheet metal. The doorside bracket may further include a doorstop disposed generally orthogonal along the segment and engageable with the portion of the bodyside bracket to stop rotation of the vehicle door. The retainer may include an angular seat for engaging a chamfered rim adjacent one of the apertures, with the angular seat and chamfered rim facilitating alignment of the vehicle door attachment unit during assembly thereof. The retainer may be placed within the rotation member and within one of the apertures, with the retainer being configured to retain the rotation member and one of the bodyside and doorside brackets. The unit may further include a locating pin and a locating hole along the bodyside bracket for receiving the locating pin, with the locating hole being oversized to provide the locating pin with a predetermined amount of translational freedom such that the vehicle door is adjustably mountable relative to the vehicle body. The doorside bracket may be attachable to the vehicle door by a fastener. The bodyside bracket may further include ribbed and flanged features for adding structural rigidity to the bodyside bracket. The portion of the bodyside bracket may be substantially parallel with the segment of the doorside bracket. In a particular embodiment, a bottom end of the fastener may be disposed generally adjacent a top end of the retainer. In another embodiment, a bottom end of the retainer may be disposed generally adjacent a top end of the fastener.

The invention also provides a method of assembling an attachment unit to rotatably couple a vehicle door to a vehicle body, with the unit having a doorside bracket, a bodyside bracket, a fastener assembly, and a rotation member. The method may include attaching the doorside bracket to the vehicle door, and attaching the bodyside bracket to the vehicle body. The method may further include press fitting a portion of the fastener assembly to retain the rotation member, and the bodyside or doorside bracket, with the rotation member being disposed between the fastener assembly and the doorside or bodyside bracket, being generally concentric to the fastener assembly, and providing rotational freedom between the fastener assembly and the doorside or bodyside bracket. The method may also include coupling the doorside bracket to the bodyside bracket by tightening the fastener assembly.

For the method described above, the bodyside and/or doorside brackets may be stamped from sheet metal. The step of attaching the bodyside bracket to the vehicle body may further include placing a locating pin through a locating hole in the bodyside bracket, calibrating location of the pin, attaching the pin to the bodyside bracket, and attaching the bodyside bracket to the vehicle body.

The invention yet further provides a method of removing a vehicle door that is rotatably coupled to a vehicle body. The method may include providing one or more attachment units rotatably coupling the vehicle door to the vehicle body, with the attachment unit including a doorside bracket attached to the vehicle door, a bodyside bracket attached to the vehicle body, a fastener assembly coupling the doorside bracket to the bodyside bracket, and a rotation member substantially concentric to the fastener assembly, being disposed between the fastener assembly and the doorside or bodyside bracket, and providing rotational freedom between the fastener assembly and the doorside or bodyside bracket. The method may also include disengaging the fastener assembly so that the doorside bracket is removable from the bodyside bracket, with the rotation member remaining maintained on one of the doorside and bodyside brackets, and lifting the doorside bracket and the door off of the bodyside bracket, with the rotation member remaining maintained on the doorside or bodyside bracket.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION OF PREFERRED EMBODIMENTS

Figure 1:
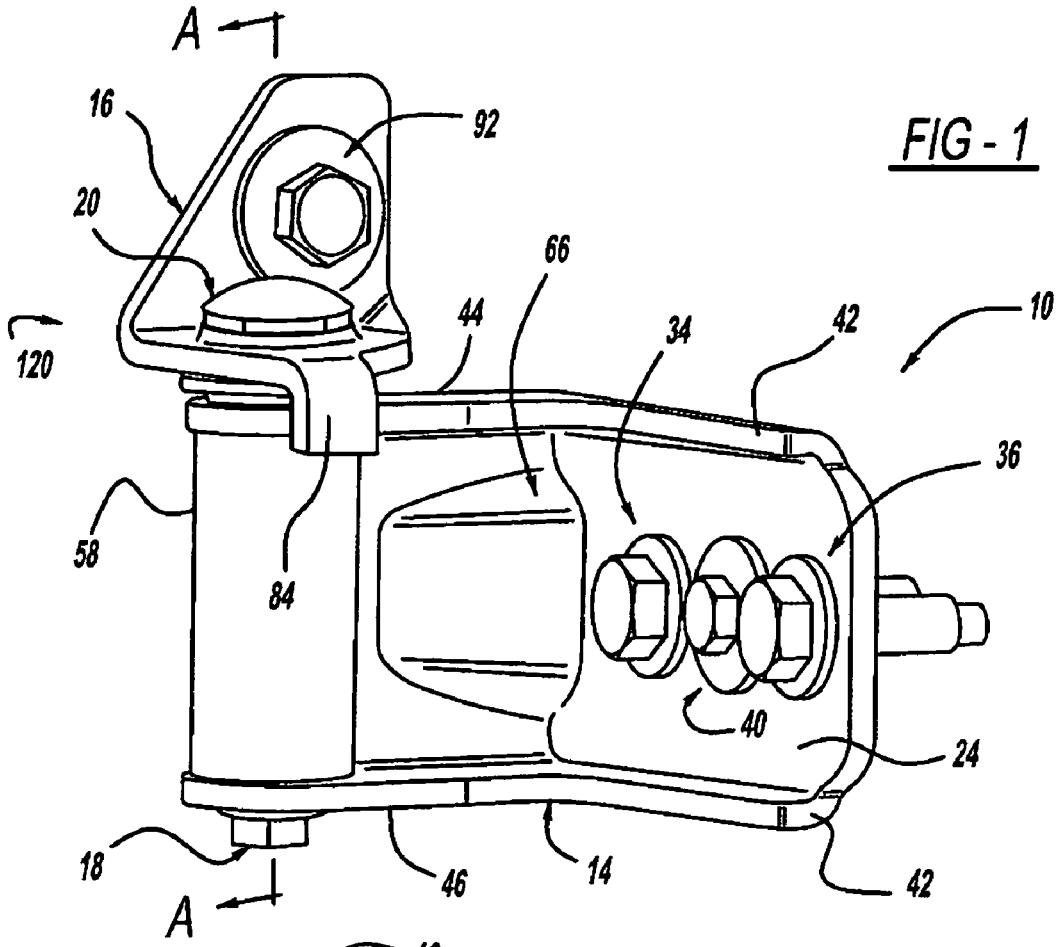
FIG. 1 is an isometric view of an upper attachment unit for attaching a vehicle door to a vehicle body member, with the attachment unit shown in a generally closed position and including a doorside bracket for attachment to the door and a bodyside bracket for attachment to the body member.

Referring now to the drawings wherein like reference numerals designate corresponding parts throughout the several views, FIGS. 1-12 illustrate various views of attachment units used for coupling vehicle doors to a vehicle body such that assembly efficiency and joint robustness are maximized. According to the present invention, the units will hereinafter be generally designated by "upper attachment unit 10" and "lower attachment unit 12."

Figure 4:
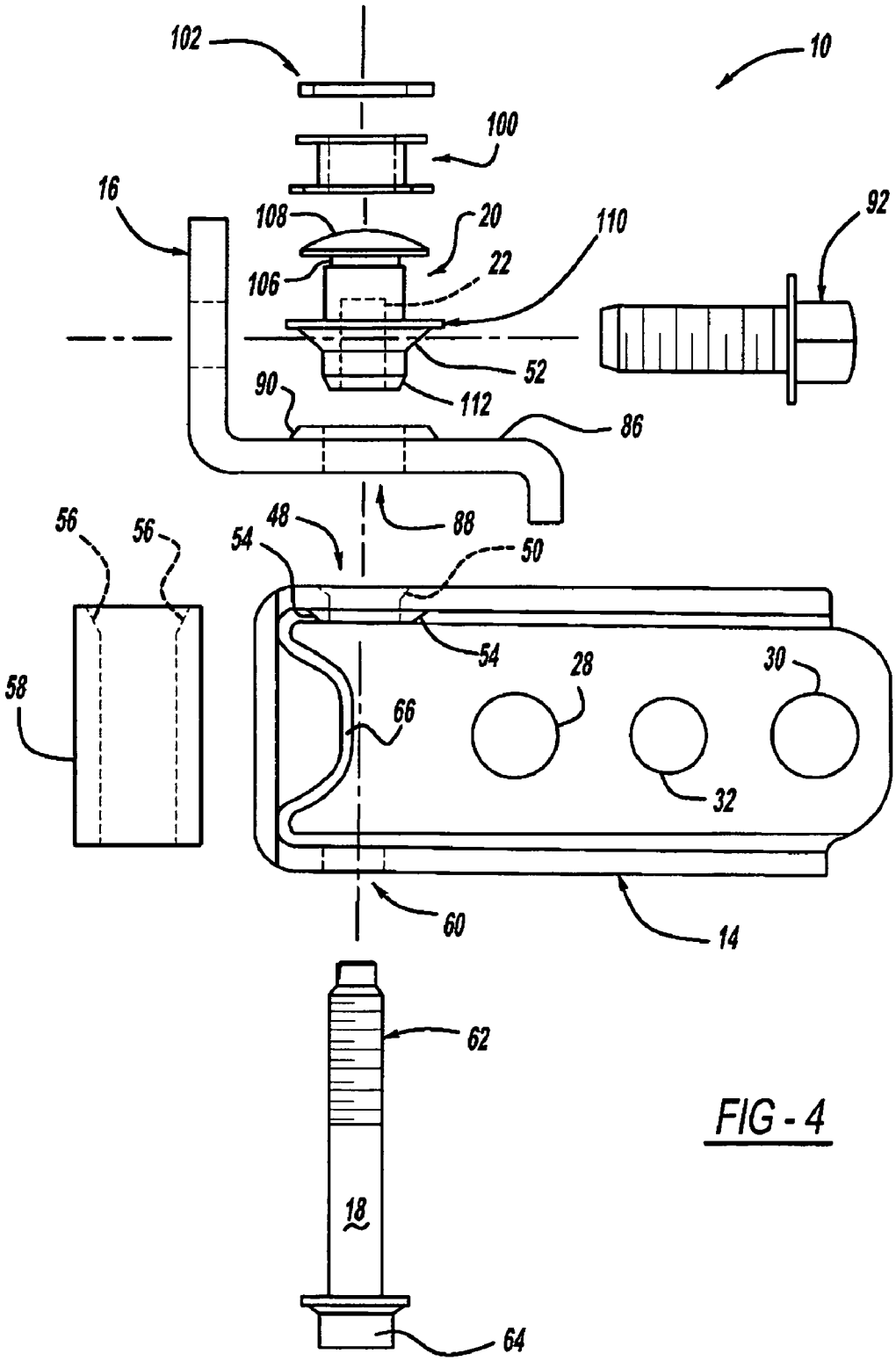
FIG. 4 is an exploded side view of the upper attachment unit of FIG. 1.
Figure 5:
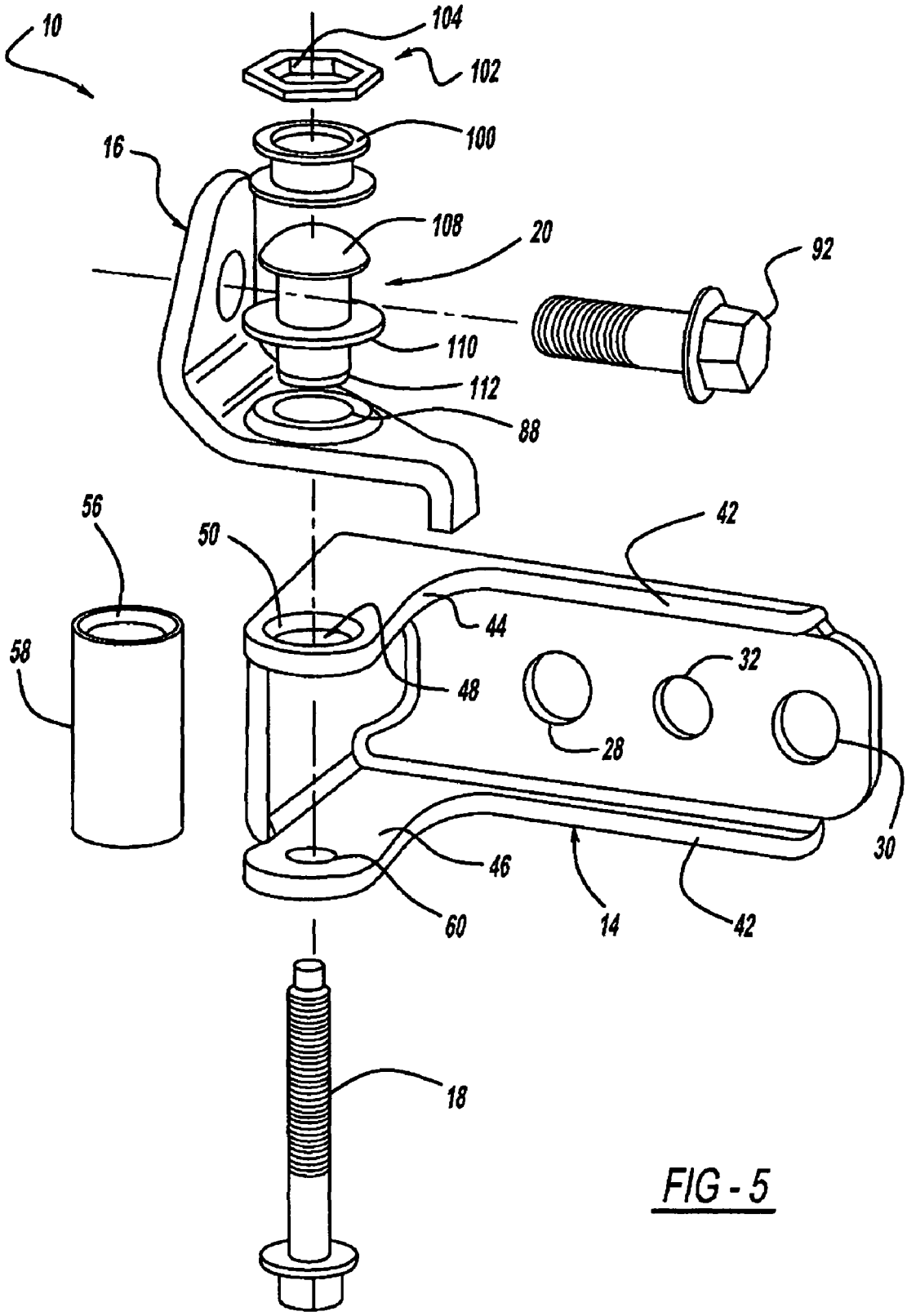
FIG. 5 is an exploded isometric view of the upper attachment unit of FIG. 1.
Figure 6:
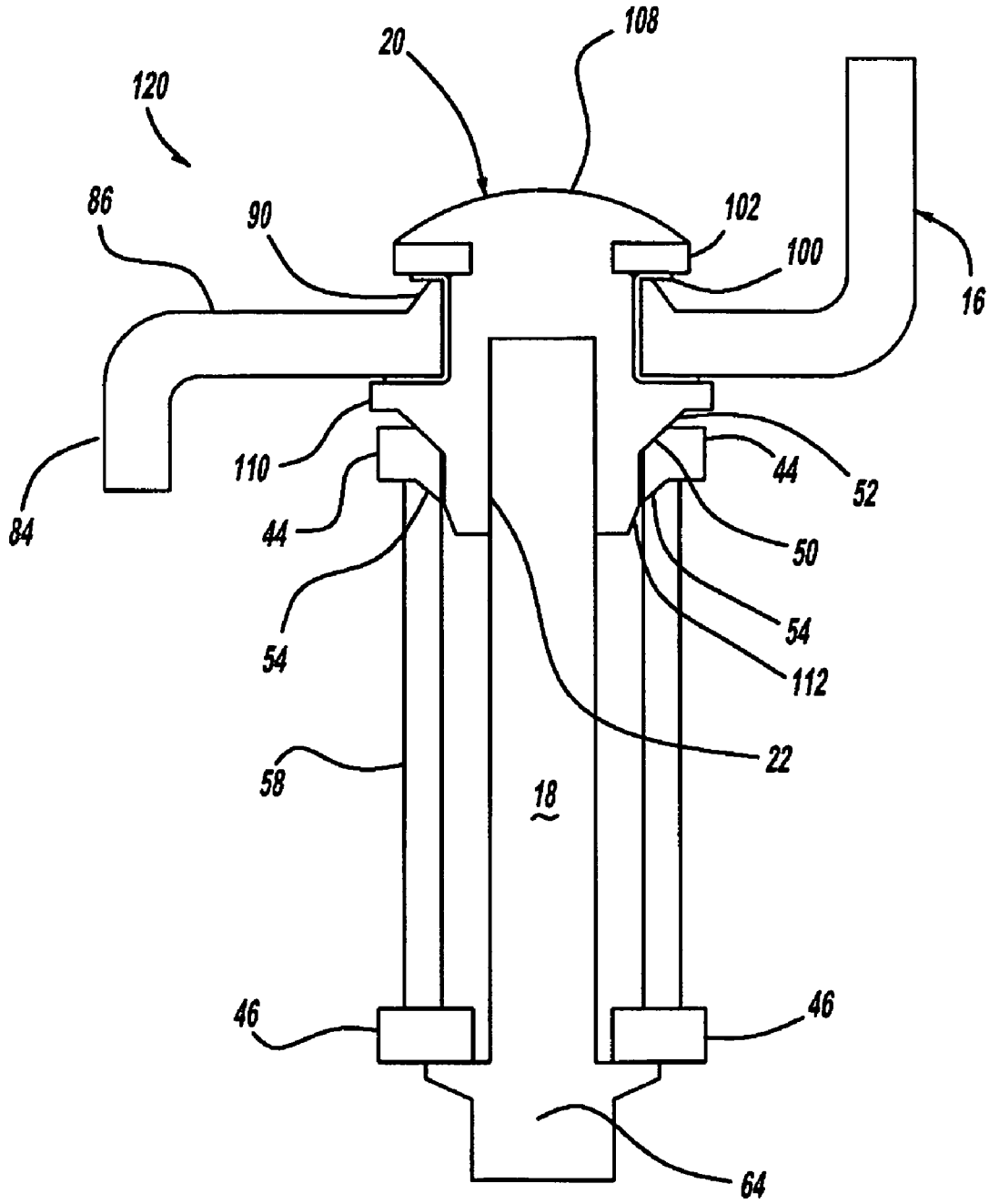
FIG. 6 is a cross-sectional view of the upper attachment unit taken generally along line A-A of FIG. 1.

As shown in FIGS. 1-6, upper attachment unit 10 may include a bodyside bracket 14 and a doorside bracket 16. As shown in FIG. 6, bodyside bracket 14 and doorside bracket 16 may generally be coupled by a central bolt 18 that engages a retainer 20 having internal threads 22. Upper attachment unit 10 may be disassembled for a doors off subassembly by disengaging central bolt 18 from retainer 20, a process which will be described in detail below.

Figure 2:
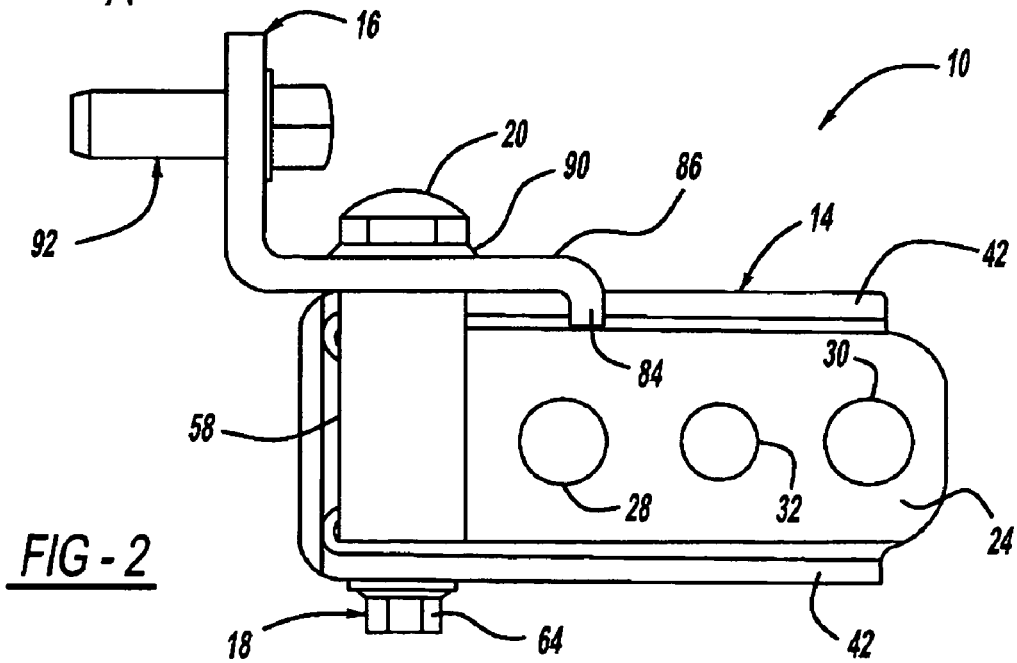
FIG. 2 is a side view of the upper attachment unit of FIG. 1 without three fasteners positioned in the bodyside bracket as shown in FIG. 1 and the attachment unit shown in the generally closed position of FIG. 1.

Referring to FIGS. 1-6 and 9, bodyside bracket 14 may have a planar section 24 that mates with a vehicle body member 26. Body member 26 may be a vehicle pillar or may be located adjacent to a vehicle opening. As shown in FIG. 2, planar section 24 may include two fastener holes 28 and 30 and a locating hole 32. In one embodiment, in order to cost effectively form bodyside bracket 14, bracket 14 may be stamped from a roll of sheet metal, and holes 28, 30, and 32 may be punched at that time. Fastener holes 28 and 30 may receive bodyside fasteners 34 and 36, which can attach upper attachment unit 10 and hence a vehicle closure member, such as a vehicle door 38 shown in FIGS. 9, 10, and 12, to a vehicle body. Fasteners 34 and 36, in one embodiment, may mate with weld nuts or some other component previously attached to or built into body member 26. In order to position the vehicle door relative to the vehicle body, locating hole 32 may receive a locating pin 40, with the operation of locating pin 40 being described in more detail below. In one aspect of the invention, stamping bodyside bracket 14 may be advantageous since it can create sufficient surface area on planar section 24 without the costs associated with machined components. This surface area can be ideal for distributing the load of bodyside fasteners 34 and 36 which may be attached to body member 26. The surface area can also be beneficial for making holes 28, 30, and 32 large enough to be capable of positioning vehicle door 38 relative to the vehicle body as needed.

In order to increase structural rigidity, bodyside bracket 14 may include flanges 42 around a portion of its periphery. In one embodiment, bodyside bracket 14 may have first and second projections 44, 46 which are generally orthogonal to planar section 24. Projections 44, 46 may be configured to protrude away from vehicle body member 26 once bodyside bracket 14 is attached to body member 26. As shown in FIG. 5, first projection 44 may contain a larger hole 48 with a chamfered rim 50, and as shown in FIG. 4, chamfered rim 50 may align and mate with a seat 52 on retainer 20 when attachment unit 10 is assembled. First projection 44 may also include a seat 54 which can be seen in FIGS. 4 and 6, and once assembled, seat 54 may mate with a conical feature 56 located at one end of a collar 58. In order to disperse loads between projections 44, 46, collar 58 may be placed therebetween. Another advantage to stamping bodyside bracket 14 is that adequate surface area along first and second projections 44, 46 may be created without the costs associated with machined parts. As shown in FIG. 4, for second projection 46, a smaller hole 60 may be vertically aligned with larger hole 48 in first projection 44. Once attachment unit 10 is assembled, central bolt 18, including threaded section 62 for engagement with retainer 20, may extend through smaller hole 60, through collar 58, and through larger hole 48.

Referring to FIG. 1, although bodyside bracket 14 is shown with two spaced-apart projections 44 and 46, embodiments may exist in which bodyside bracket 14 takes on a different shape without compromising the functionality of the invention. For example, the space between first and second projections 44, 46 may be reduced, or even eliminated, so that only one projection exists. Of course, the dimensions of a single projection may need modification, but such a design may be advantageous when under various packaging constraints. In an effort to minimize weight and material costs, bodyside bracket 14 may be tapered by removing a portion of planar section 24 closest to projections 44 and 46 and reducing the distance between projections 44 and 46. In yet another example, a ribbed segment 66 of bodyside bracket 14 may be stamped between projections 44 and 46 to stiffen bracket 14.

Figure 3:
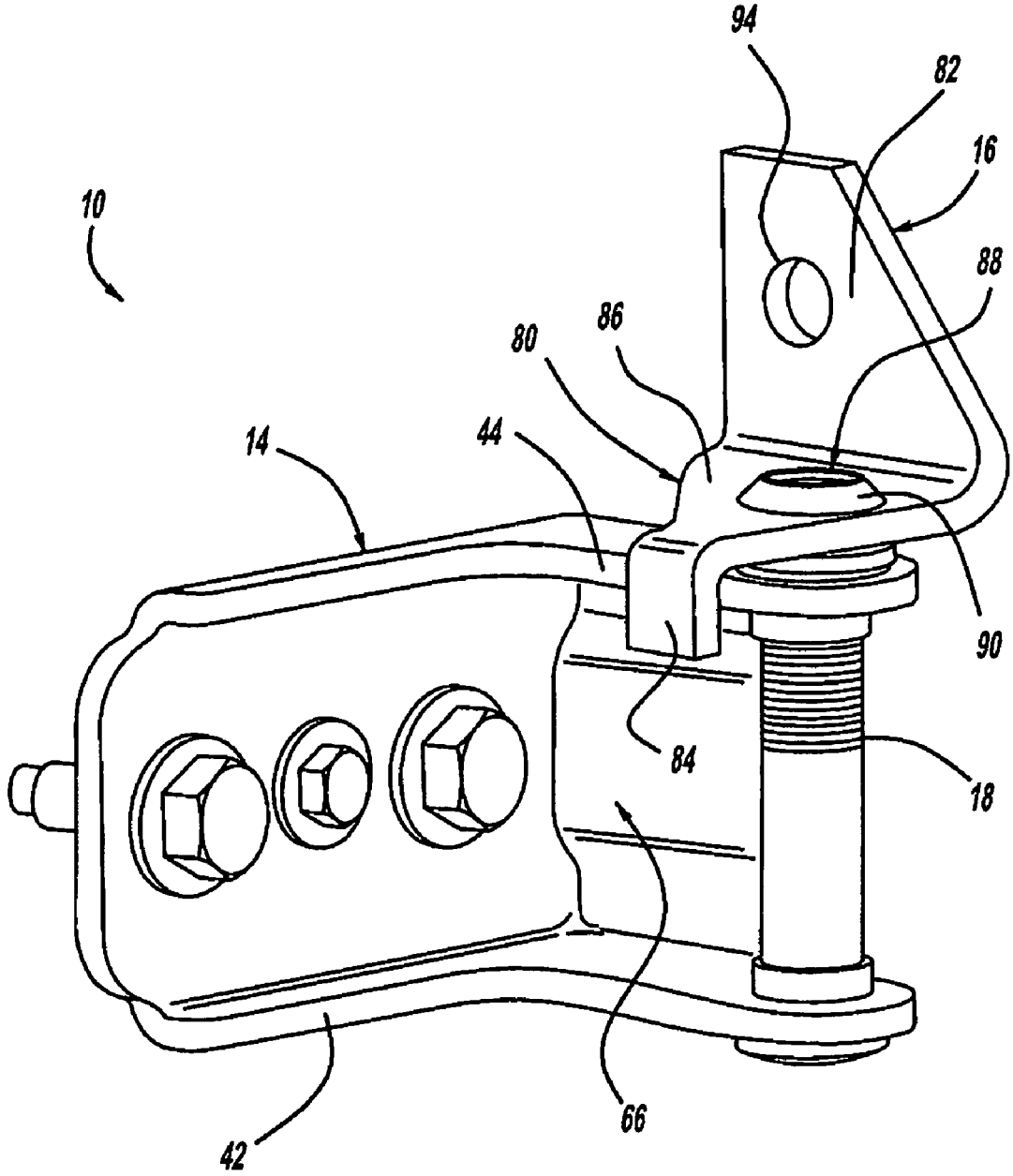
FIG. 3 is an isometric view of a mirror image attachment unit for use on an opposite side of a vehicle, similar to the unit of FIG. 1, with certain components omitted for clarity.

Referring to FIG. 3, similar to upper attachment unit 10 illustrated in FIG. 1, mirror image unit 10 of FIG. 3 may be formed for use on the other side of a vehicle. Doorside bracket 16, a substantially common part that may be used in both upper attachment unit 10 and lower attachment unit 12 (with minor modifications as discussed below for bracket 128), may generally include a horizontal portion 80 connected to a vertical portion 82, and a doorstop 84. More specifically, horizontal portion 80 may have an upper surface 86 and a hole 88 extending vertically therethrough, with upper surface 86 including a shoulder 90. Vertical portion 82 may be attached to a vehicle door, such as door 38 shown in FIG. 9. As shown in FIGS. 3 and 5, a fastener 92 may be placed through a hole 94 in vertical portion 82 and engage with a mating component (not shown), such as a weld nut on vehicle door 38. When looking down on upper attachment unit 10 in the FIG. 3 orientation, doorstop 84 may rotate in a clockwise direction when an attached vehicle door (not shown) is opened, with doorstop 84 contacting first projection 44 to limit opening movement of the door. While doorstop 84 may be used as a primary means of stopping vehicle door rotation, doorstop 84 may also be used in conjunction with other components for stopping door rotation as would be readily evident to those skilled in the art.

The assembly of upper attachment unit 10, particularly how bodyside bracket 14 and doorside bracket 16 function together, will now be described in detail.

The assembly of upper attachment unit 10 will be described with reference to FIGS. 4 and 5 and the fully assembled, cross-sectional view of FIG. 6 showing assembled unit 10. As discussed above, in order to clamp bodyside bracket 14 and doorside bracket 16 together, central bolt 18 may engage with internal threads 22 in retainer 20. Collar 58 may be inserted between first projection 44 and second projection 46, with conical feature 56 aligning with seat 54 of first projection 44. Central bolt 18 may then be inserted up through smaller hole 60, through collar 58, and through larger hole 48.

Retainer 20, the upper portion of which in the FIGS. 4 and 5 orientation is initially an elongated shaft, may be press fitted into its final shape, as seen in FIGS. 5 and 6, after a bearing 100 and a non-circular washer 102 have been placed around retainer 20 and this arrangement of components has been placed within hole 88 of doorside bracket 16. In one embodiment, non-circular washer 102 may be placed above bearing 100 and may serve primarily as an assembly aid. Referring to FIGS. 4 and 5, washer 102 may also have a non-circular inset 104 which constrains, particularly after press fitting, mating portion 106 of retainer 20. With non-circular inset 104, torque, or counter torque, can be loaded on washer 102 which ultimately transmits the load to mating portion 106 of retainer 20. This is helpful when rotatably driving central bolt 18 into retainer 20. In another embodiment (not shown), retainer 20 can be formed without a spherical head 108, eliminating the need for washer 102. In any case, after placing this arrangement within hole 88, as shown in FIG. 6, retainer 20 may be press fitted to form spherical head 108, with pre-formed lip 110 engaging bearing 100 to facilitate pivotal movement of doorside bracket 16. Thus, bearing 100 may be oriented to provide freedom between doorside bracket 16 and retainer 20 to generally form a rotatable upper hinge 120. Press fitting retainer 20 to hold bearing 100, washer 102, and doorside bracket 16 all in one subassembly allows for a simple lift off procedure on the vehicle assembly line by removal of central bolt 18 from the assembled upper attachment unit 10, as discussed in detail below.

At this point, doorside bracket 16 may be arranged just above bodyside bracket 14. Alignment aid 112 on retainer 20 may help guide retainer 20 into larger hole 48 in first projection 44 of bodyside bracket 14. Seat 52 of retainer 20 can mate with chamfered rim 50 along larger hole 48 to further help align retainer 20 with larger hole 48. Once aligned, as illustrated in FIG. 6, central bolt 18 may be driven to engage internal threads 22 in retainer 20 as non-circular washer 102 is held in place. This driving action may clamp bodyside bracket 14 to doorside bracket 16. As previously mentioned, vehicle hinges are ideally tight joints with high precision to enable smooth rotation over time. One way to achieve high precision in vehicle hinges may require never taking them apart after initial assembly. This drawback with conventional lift off hinges is overcome by upper attachment unit 10 for which after the initial formation of rotatable upper hinge 120, central bolt 18 can be driven in and out of retainer 20 without rotatable upper hinge 120 coming apart.

Lower attachment unit 12 and its assembly will now be described in detail with reference to FIGS. 7A, 7B and 8.

Lower attachment unit 12 may be generally similar to upper attachment unit 10, except as discussed below. As discussed above, instead of doorside bracket 16, a modified doorside bracket 128 may be used with lower attachment unit 12. FIG. 7A shows lower attachment unit 12 which may have a bodyside bracket 130, generally similar to bodyside bracket 14, with fasteners 132 and 134 extending through two holes (not shown) for attachment to vehicle body member 26. A mirror image counterpart to lower attachment unit 12 can be seen in FIG. 7B for use with an opposite door. Unit 12 may include a planar section 136 for attachment to body member 26. As with bodyside bracket 14, bodyside bracket 130 may be cost effectively stamped from rolled sheet metal to avoid the costs associated with machined components. Bodyside bracket 130 may also have first and second projections 138, 140, with doorside bracket 128 located above first projection 138 when assembled.

First and second projections 138, 140 may have holes that are vertically aligned with one another. Unlike upper attachment unit 10 that uses bearing 100 within hole 88 in doorside bracket 16, lower attachment unit 12 may have a bearing 142 inside the hole in first projection 138 and a bearing 144 inside the hole in second projection 140. Similar to upper attachment unit 10, an elongated retainer 146 may be press fitted for use with lower attachment unit 12, as best shown in FIG. 8. Prior to press fitting, a non-circular washer 150, bearing 144, bodyside bracket 130, and bearing 142 may be placed around elongated retainer 146 and held in place by lip 148. After press fitting, lip portion 148 and a press fitting formed spherical head 154 retain these components as a subassembly. A rotatable lower hinge 156 is thus formed in the same process by orienting bearings 142 and 144 to provide freedom between elongated retainer 146 and first and second projections 138, 140. At this stage, rotatable lower hinge 156 has been assembled separate from any joints that will be disassembled at any stage of the vehicle assembly process.

Figure 7A:
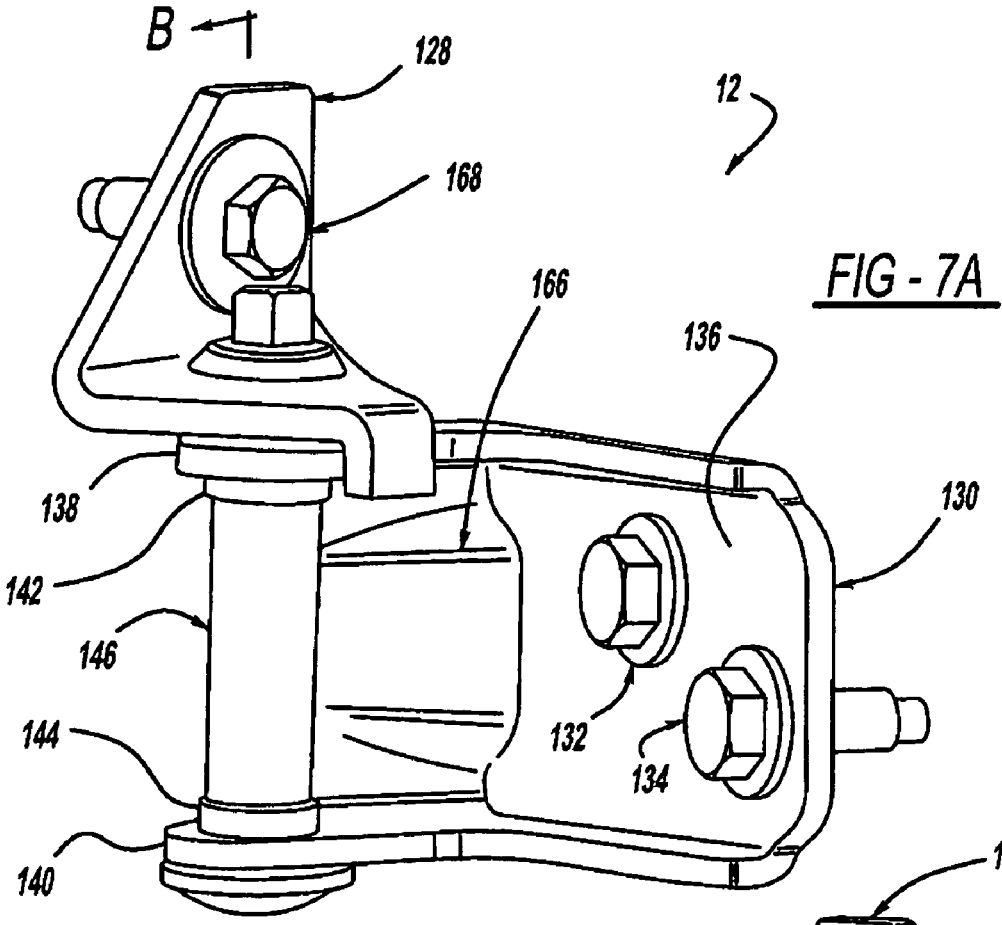
FIG. 7A is an isometric view of a lower attachment unit used for attaching a vehicle door to a vehicle body member at a second location generally below the upper attachment unit of FIG. 1, with the lower attachment unit shown in a generally closed position.
Figure 7B:
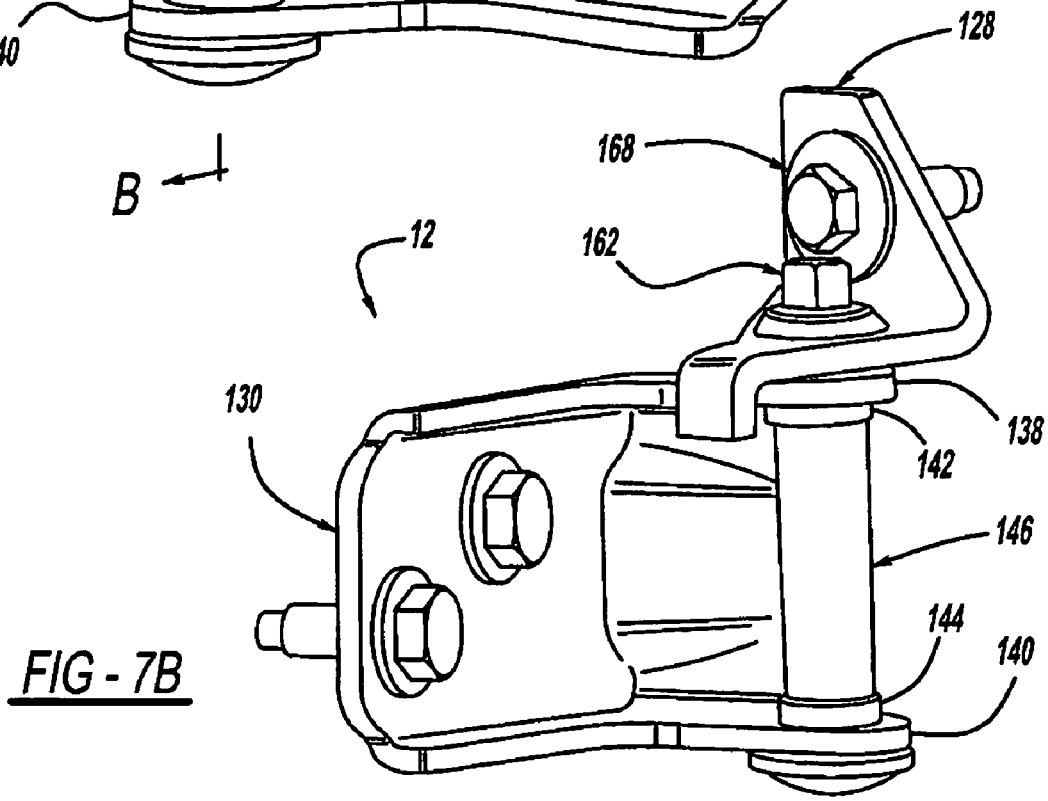
FIG. 7B is an isometric view of a mirror image lower attachment unit, similar to the unit of FIG. 7A.
Figure 8:
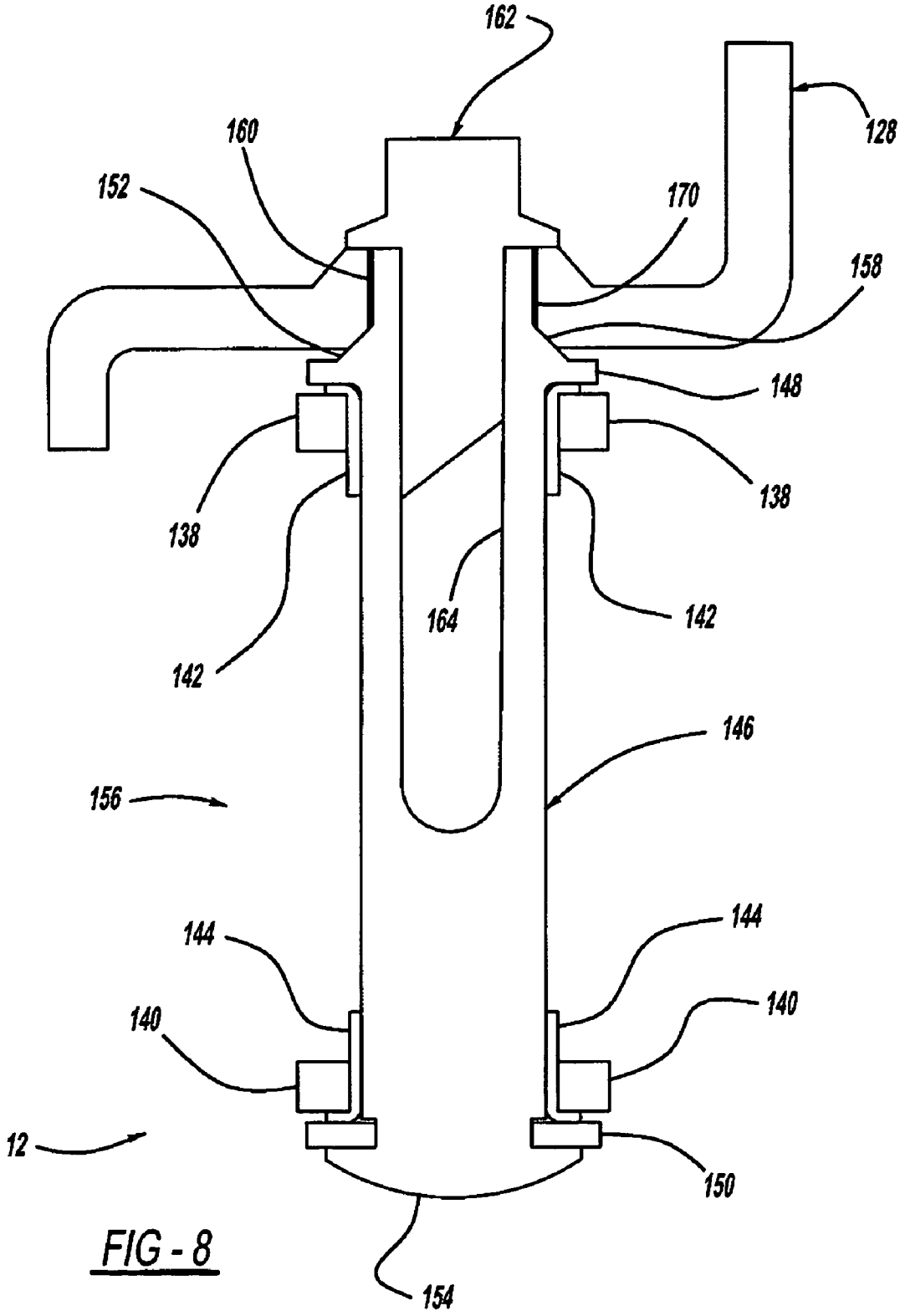
FIG. 8 is a cross-sectional view of the lower attachment unit taken generally along line B-B of FIG. 7A.

Rotatable lower hinge 156 may now be attached to doorside bracket 128, as shown in FIGS. 7A, 7B and 8. A chamfered portion 158 of hole 170 in doorside bracket 128 and seat 152 of elongated retainer 146 help align lower attachment unit 12 and create a snug fit, and section 160 of elongated retainer 146 fits within hole 170 to further facilitate rotation of doorside bracket 128 relative to bodyside bracket 130. In one embodiment, chamfered portion 158 on doorside bracket 128 may be common to both upper and lower attachment units 10, 12, and in another embodiment (as shown in FIG. 8), chamfered portion 158 may be unique to doorside bracket 128 used with lower attachment unit 12. Lastly, a central bolt 162 may be inserted into elongated retainer 146 to engage with internal threads 164. Therefore, once assembled, lower attachment unit 12 may be disassembled on the vehicle assembly line without impacting rotatable lower hinge 156, similar to disassembly of upper attachment unit 10. Lower attachment unit 12 may include additional similar features as discussed above for upper attachment unit 10. For example, lower attachment unit 12 may include a ribbed segment 166 as shown in FIG. 7A or a tapered bodyside bracket as previously discussed.

The initial attachment of vehicle door 38 to vehicle body member 26 will now be described in more detail with reference to FIGS. 9-12.

Once upper and lower attachment units 10, 12 are initially assembled, vehicle door 38 may be placed in a fixture (not shown) where units 10, 12 may be attached. In order to attach units 10, 12 to vehicle door 38, fastener 92 on upper attachment unit 10 and a fastener 168 on lower attachment unit 12 may be driven into mating components on door 38. In order to properly align bodyside bracket 14 along vehicle body member 26, locating pin 40 may then be placed through locating hole 32 which may be larger than the shank diameter of locating pin 40, thus allowing pin 40 to have some degree of translational freedom within hole 32. Locating pin 40 may thus be fixed to bodyside bracket 14 once aligned with a precise hole in the fixture. This precise hole may receive locating pin 40, and represent the accurate location along body member 26 on which door 38 should be attached. Next, vehicle door 38 may be attached to body member 26 by placing locating pin 40 in a corresponding hole on body member 26. Since pin 40 may still rotate with door 38 attached, an additional reference point may be used. This additional reference may include, for example, aligning a hole on door 38 with a hole on body member 26 or aligning a door latch unit location with a striker member. Generally, door 38 can be attached to body member 26 with accuracy when the additional reference is farthest away from locating pin 40. This may be one reason why lower attachment unit 12 need not serve as the additional reference and need not have its own locating pin. Once aligned, fasteners 34, 36, 132, and 134, which likewise may have some degree of translational freedom, can be driven into mating components on body member 26.

Alternatively, vehicle door 38 may be aligned to vehicle body member 26 with a laser positioning system as opposed to using locating pin 40. Like locating pin 40, the laser system could similarly align points along door 38 with corresponding points along the periphery of the door opening.

Figure 9:
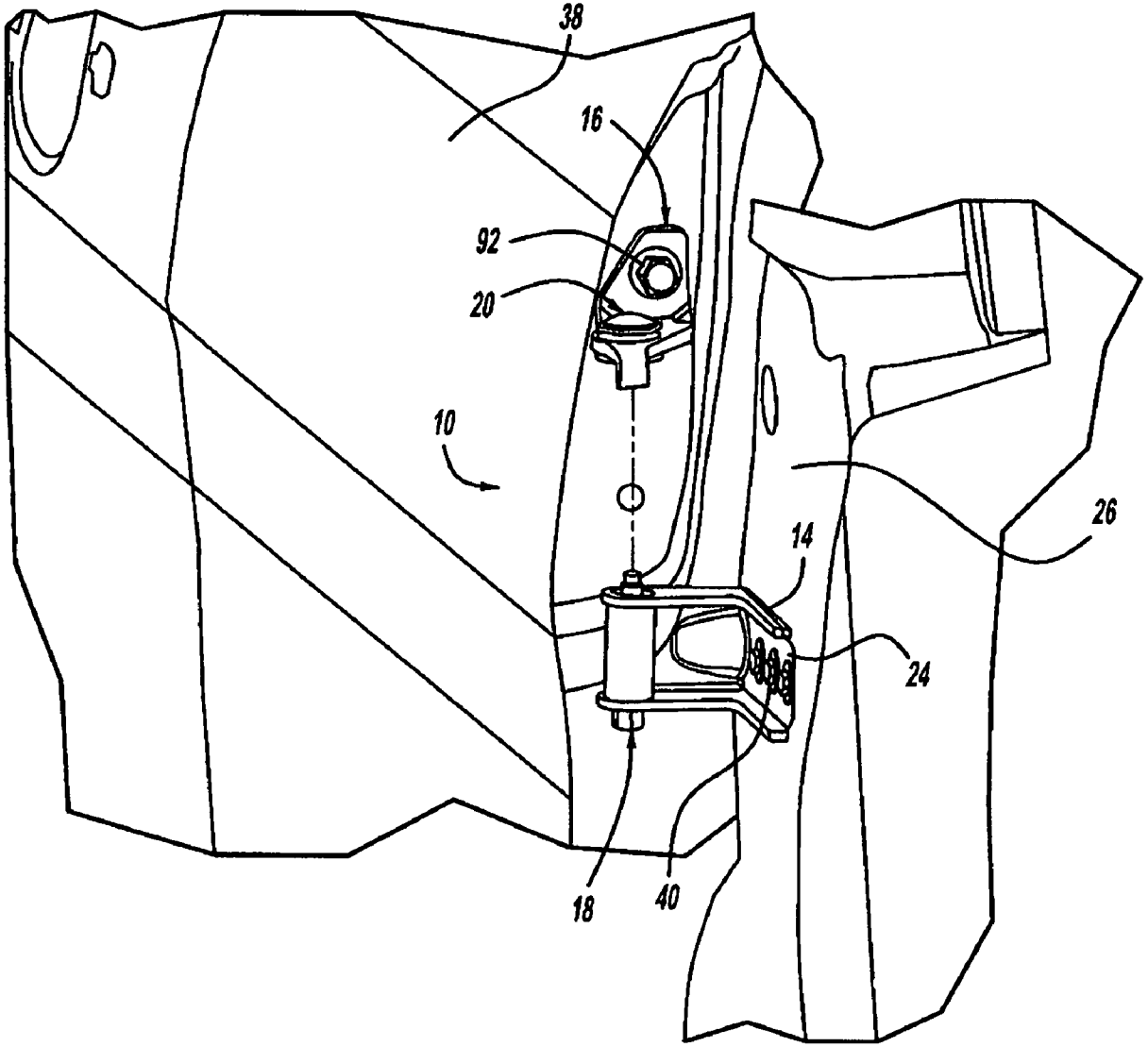
FIG. 9 is an isometric view of the upper attachment unit of FIG. 1, including the doorside bracket attached to the vehicle door and the bodyside bracket attached to the vehicle body member, with the unit in a disassembled configuration with the door and doorside bracket being lifted off the bodyside bracket and the body member.
Figure 10:
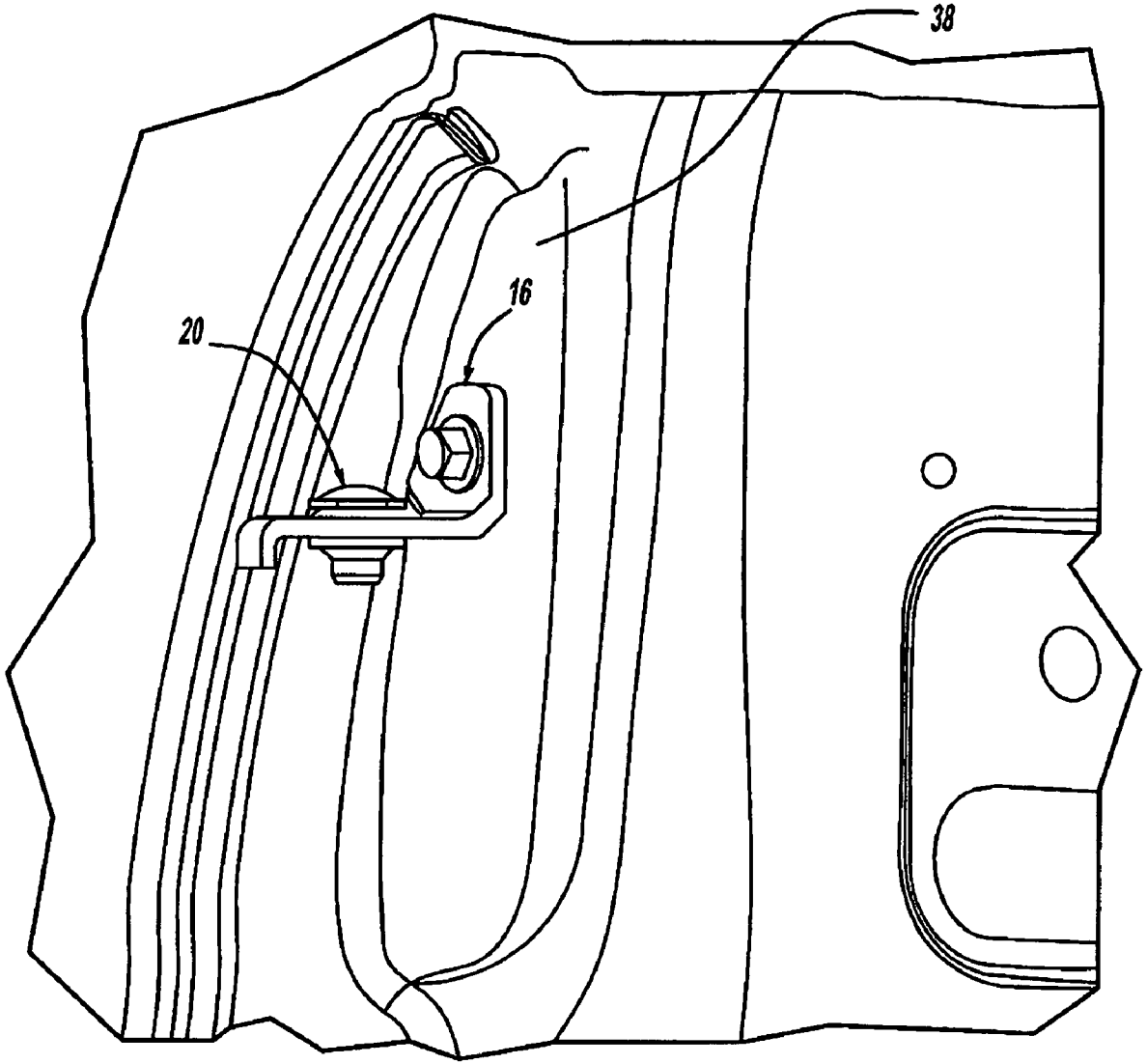
FIG. 10 is a side view of a doorside bracket attached to the vehicle door, the upper attachment unit disassembled such that the doorside bracket is detached from the bodyside bracket.
Figure 11:
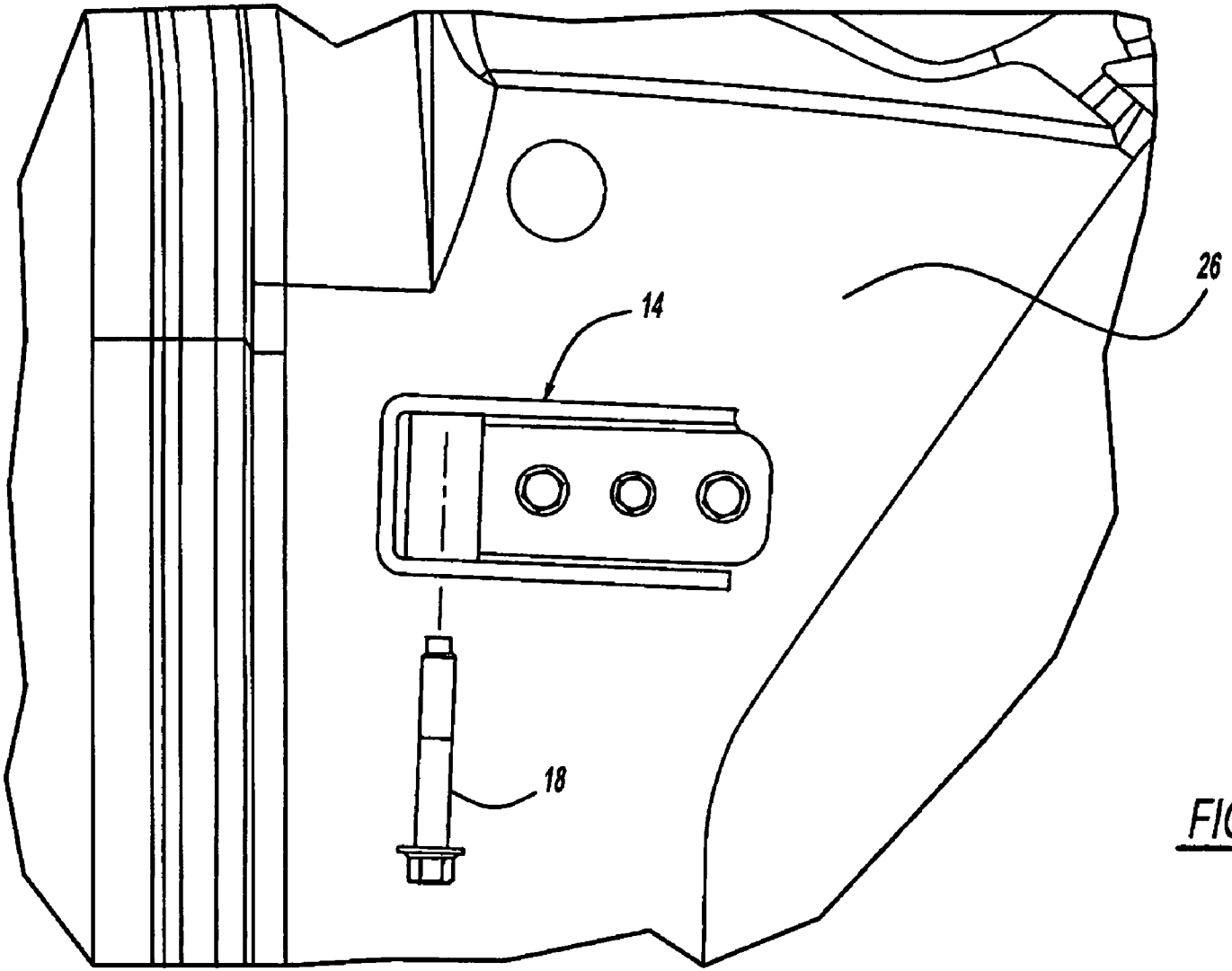
FIG. 11, compared to FIG. 10, is a side view of a bodyside bracket and body member after disassembling the upper attachment unit.

In order to provide increased access for installing various internal vehicle components, door 38 may be temporarily removed from vehicle body member 26 as discussed below. This procedure may also be advantageous for a doors off subassembly of door 38. In an effort to efficiently and expediently remove door 38 from body member 26, central bolt 18 of upper attachment unit 10 may be removed from retainer 20 and central bolt 162 of lower attachment unit 12 may be removed from elongated retainer 146. Bolts 18 and 162 may serve as two controlling fasteners for detaching and reattaching vehicle door 38 to body member 26. Removing bolts 18 and 162 does not alter or disassemble rotatable upper hinge 120 and rotatable lower hinge 156, which remain intact and unaffected by this temporary removal of door 38. At this point, vehicle door 38 may be lifted off body member 26 as shown in FIG. 9. Doorside bracket 16 can remain attached to door 38 as illustrated in FIG. 10, and bodyside bracket 14 can remain attached to body member 26 as illustrated in FIG. 11. Bodyside bracket 130 of lower attachment unit 12 can similarly remain attached to body member 26 and doorside bracket 128 of lower attachment unit 12 can remain attached to door 38.

In order to facilitate the aforementioned assembly and disassembly processes, upper attachment unit 10 is configured so that central bolt 18 may be removed from the bottom of unit 10, and lower attachment unit 12 is configured so that central bolt 162 may be removed from the top of unit 12. This configuration may be advantageous because it provides clearance for tooling on the assembly line. Since modern styling in vehicle doors typically features a rounded profile along tops and bottoms of doors, clearance for tooling can become a problem if upper attachment units are designed to be driven from the top and lower attachment units are designed to be driven from the bottom. The design of upper and lower attachment units 10 and 12 of the present invention avoids this problem.

When the time is appropriate for door 38 to be reattached to body member 26, upper and lower attachment units 10, 12 may once again take advantage of the alignment features mentioned further above. These alignment features, such as chamfered rim 50 and seat 52 or chamfered portion 158 and seat 152, help expedite the initial attachment and also the reattachment processes. New central bolts may replace central bolts 18 and 162, or the original central bolts 18 and 162 may be driven back into retainer 20 and elongated retainer 146, respectively.

Figure 12:
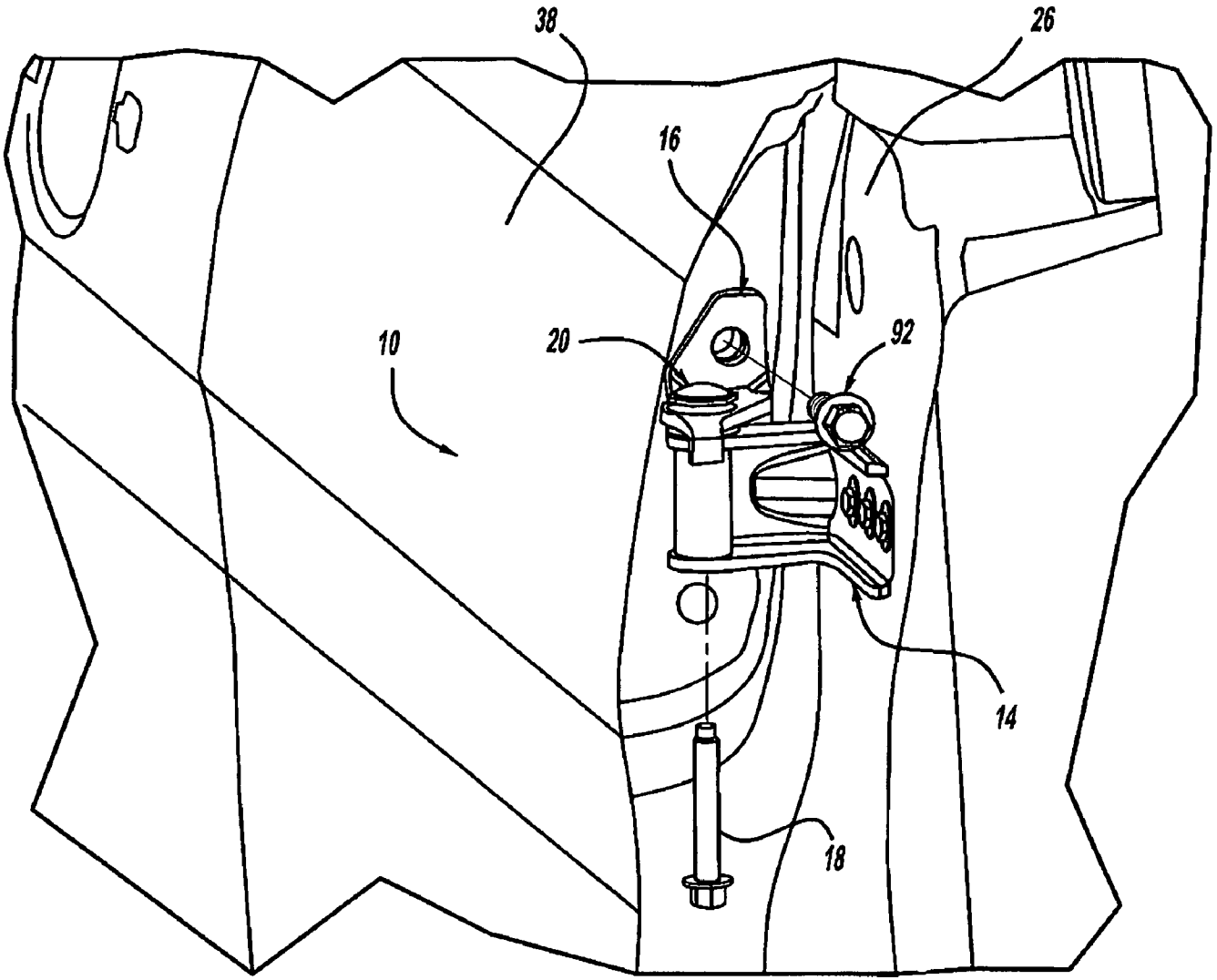
FIG. 12 is an isometric view of the upper attachment unit of FIG. 1 with a central bolt and a doorside fastener ready to be installed.

In an alternative operation, FIG. 12 illustrates how either central bolt 18 or fastener 92 may be temporarily removed when vehicle door 38 is removed from body member 26. The same concept may be applied to lower attachment unit 12 as well. Such an option could also keep rotatable upper hinge 120 and rotatable lower hinge 156 intact during disassembly and reattachment of upper and lower attachment units 10 and 12. The option of removing fastener 92 would provide an alternative path for tooling and may be helpful for compact vehicle closure members with aggressive profile curvature.

Those skilled in the art would appreciate in view of this disclosure that in other embodiments two upper attachment units 10 or two lower attachment units 12 may be used instead of one upper attachment unit 10 and one lower attachment unit 12. Hence the terminology "upper" and "lower" is used throughout this description only for facilitating a better understanding of the invention. Yet further, the present invention is not limited to vehicle side doors. Upper attachment unit 10 or lower attachment unit 12 may readily be used to hingedly attach a tailgate, a trunk, a rear vehicle door etc.

To summarize, the invention thus provides a durable and robust door-to-body hinge system including upper and lower attachment units 10, 12, the hinges of which remain intact when the door is lifted off the vehicle body for separate subassembly. The invention further provides a hinge system that uses cost effective stamped components, and minimal joints for attaching, removing, and reattaching a door to a vehicle body.

Although particular embodiments have been described in detail herein with reference to the accompanying drawings, it is to be understood that the invention is not limited to those particular embodiments, and that various changes and modifications may be affected therein by one skilled in the art without departing from the scope or spirit of the invention as defined in the appended claims.

What is claimed is:

1. A vehicle door attachment unit for rotatably and detachably coupling a vehicle door to a vehicle body, the unit comprising:

a bodyside bracket mountable to the vehicle body and having a portion extending generally away from the vehicle body, the portion having an aperture;

a doorside bracket mountable to the vehicle door and having a segment extending generally away from the vehicle door, the segment having a further aperture alignable with the aperture in the portion of the bodyside bracket;

a retainer extending into at least one of the apertures;

a fastener extending through at least one of the apertures and capable of mating with the retainer to substantially align the apertures;

a non-circular washer around the retainer; and a rotation member operatively engaged with the retainer for providing rotational freedom between the retainer and one of the bodyside and doorside brackets, wherein the retainer and rotation member remain assembled as a subassembly on one of the doorside bracket and bodyside bracket during detachment of the doorside bracket from the bodyside bracket, and wherein the non-circular washer comprises a non-circular inset, wherein torque can be loaded on the washer to transmit load to a mating portion of the retainer mechanism.

2. A vehicle door attachment unit for rotatably and detachably coupling a vehicle door to a vehicle body, the unit comprising:

a bodyside bracket mountable to the vehicle body and having first and second portions with respective first and second apertures, the first and second portions extending generally away from the vehicle body;

a doorside bracket mountable to the vehicle door and having a segment with a third aperture, the segment extending generally away from the vehicle door;

a retaining mechanism extending into the third aperture, and through at least one of the first and second apertures;

a fastener extending through at least one of the first, second and third apertures and capable of mating with the retaining mechanism to substantially align the first, second, and third apertures;

a non-circular washer around the retaining mechanism; and a bearing disposed on the retaining mechanism for providing rotational freedom between the retaining mechanism and one of the bodyside and doorside brackets, wherein the retaining mechanism, the non-circular washer and the bearing remain assembled as a subassembly on one of the doorside bracket and bodyside bracket during detachment of the doorside bracket from the bodyside bracket, and wherein the non-circular washer comprises a non-circular inset, wherein torque can be loaded on the washer to transmit load to a mating portion of the retainer mechanism.

3. A vehicle door unit for rotatably and detachably coupling a vehicle door to a vehicle body, the unit comprising:

a bodyside bracket mountable to the vehicle body and having a portion extending generally away from the vehicle body, the portion having a first aperture;

a doorside bracket mountable to the vehicle door and having a segment extending generally away from the vehicle door, the segment having a second aperture alignable with the first aperture;

a retainer extending into the first and second apertures;

a fastener extending through the first and second apertures to mate with the retainer to align the first and second apertures;

a non-circular washer around the retainer, wherein torque can be loaded on the non-circular washer to transmit load to a mating portion of the retainer; and a bearing disposed on the retainer for providing rotational freedom between the retainer and one of the bodyside and doorside brackets, wherein the retainer, the non-circular washer, and the bearing remain assembled as a subassembly on one of the doorside bracket and the bodyside bracket during detachment of the doorside bracket from the bodyside bracket.

* * * * *